United States Patent [19]

Kossel

[11] 4,313,404

[45] Feb. 2, 1982

[54] INTERNAL COMBUSTION ENGINE

[75] Inventor: Horst K. Kossel, 22 Whippoorwill Dr., Shrewsbury, Mass. 01545

[73] Assignees: H. St. Pierre; H. Marc; H. K. Kossel, all of Worcester, Mass.

[21] Appl. No.: 34,866

[22] Filed: Apr. 30, 1979

[51] Int. Cl.[3] ..... F02B 75/26

[52] U.S. Cl. ..... 123/58 BB; 123/190 BA; 123/2; 123/593

[58] Field of Search ..... 123/2, 58 R, 58 B, 58 BA, 123/58 BB, 80 R, 80 D, 80 BA, 80 BB, 190 R, 190 B, 190 BA, 190 BF, 190 D, 190 DA, 139 BC, 141, 590, 593

[56] References Cited

U.S. PATENT DOCUMENTS

| | | | |
|---|---|---|---|
| 712,805 | 11/1902 | Judson | 123/58 BA |
| 1,300,098 | 4/1919 | Almen | 123/58 BB |
| 1,411,556 | 4/1922 | Almen | 123/58 BB |
| 1,843,162 | 2/1932 | Jahnke et al. | 123/2 |
| 1,895,206 | 1/1933 | Ricardo | 123/190 B |
| 2,403,282 | 7/1946 | Holmes | 123/190 BA |
| 2,891,532 | 6/1959 | Turlay | 123/139 BC |
| 4,022,176 | 5/1977 | Taylor | 123/141 |
| 4,090,478 | 5/1978 | Trimble et al. | 123/58 R |

FOREIGN PATENT DOCUMENTS

| | | | |
|---|---|---|---|
| 873630 | 3/1953 | Fed. Rep. of Germany | 123/58 BA |

*Primary Examiner*—Craig R. Feinberg

*Attorney, Agent, or Firm*—Wolf, Greenfield & Sacks

[57] ABSTRACT

The engine is of the continuous combustion type having two multiple piston banks separated by a centrally disposed undulating spider drive member operated from the piston action and adapted to drive the output power shaft of the engine. The engine comprises a water-jacketed block defining preferably eight cylinders in each bank for receiving eight pistons in each bank. Aligned pistons of respective banks are interconnected in a linear non-rotatable arrangement with the spider drive member. The spider drive member is continuously skewed to the output shaft, includes bearing means and operates on an eccentric basis driven from the piston connecting rods on a timed basis. The output power shaft supports a rotor defining valving ports including upper and lower intake ports and a transfer port. The gas-air carburization occurs within the rotor with the use of a porous medium. A rotating cavity or passage in the rotor enables continuous combustion by connecting, in turn in each bank separately, adjacent cylinders thus carrying combustion already initiated in a previous cylinder to the next cylinder on a continuous basis.

18 Claims, 16 Drawing Figures

INTERNAL COMBUSTION ENGINE

BACKGROUND AND SUMMARY OF THE INVENTION

The present invention relates in general to an improved internal combustion engine, and more particularly, to an internal combustion engine that features continuous combustion. The engine of this invention employs tandem operating piston banks with one bank on either side of a centrally disposed spider drive member or power transfer member controlled under piston action for driving the output power shaft of the engine.

One object of the present invention is to provide an improved internal combustion engine characterized by improved gasoline mileage and efficiency.

Another object of the present invention is to provide an improved internal combustion engine that provides for gas-air carburization within the engine block itself. Air is drawn into the engine block, into the cylinder below the piston, and then transferred and mixed with the incoming fuel whereupon it is introduced into the cylinder as the previously ignited mixture is exhausted.

Another object of the present invention is to provide an improved internal combustion engine that provides for more complete burning of the products of combustion.

Still another object of the present invention is to provide an internal combustion engine having an improved power transfer member for converting the linear piston operation into rotary shaft motion.

Another object of the present invention is to provide winding means in association with the rotor of the internal combustion engine for concurrently generating electrical power directly from the engine.

Still another object of the present invention is to provide an improved internal combustion engine that has a minimum number of parts, is relatively light in weight and than can be constructed relatively compactly.

A further object of the present invention is to provide an improved internal combustion engine that is of a fully balanced design.

To accomplish the foregoing and other objects of this invention there is provided an internal combustion engine that comprises an engine block having means defining a plurality of cylinders arranged in a circular locus. Preferably, the engine block has two banks of cylinders separated by a power transfer compartment which is between the banks of cylinders. The engine also includes output shaft means, means for supporting the output shaft means in a rotatable position in the engine block and a plurality of pistons received in a cylinder and each having connecting means extending therefrom and into the power transfer compartment. Each bank is provided with the same number of cylinders and thus the same number of pistons with corresponding piston pairs, one from each bank, being in linear fixed alignment. They are in fixed alignment with regard to the rotation of the output shaft but of course oscillate in a linear fashion. In the disclosed embodiment there is a common connecting means used for the aligned pistons. The engine block has means defining at least one exhaust port and at least one intake port for each cylinder. Rotor means are secured to the output shaft means and is rotatable therewity. For the two bank version, there is a rotor associated with each bank and the rotor has at least one intake passage for coupling an air-gas mixture to the cylinder via the intake port in the block. Within the power transfer compartment there is provided an eccentrically-operated power transfer means which converts linear piston action into rotary output shaft action. This power transfer means includes an inner member that is fixed with the output shaft and an outer member coupled to the piston connecting means permitting undulation of the power transfer means with the outer member non-rotating relative to the output shaft. The power transfer means also includes bearing means disposed between the inner and outer members for permitting relative rotation therebetween. The inner and outer members along with the bearing means form a plate which may be referred to as a modified swash plate which is at all positions, skewed to the axis of the output shaft means. The joint that interconnects the power transfer means and the piston connecting means includes a sliding joint that enables undulation of the outer member while maintaining the connecting means in only linear motion. In this regard the engine block preferably has means defining a guide for the piston connecting means to limit the connecting means to only linear motion.

The power transfer compartment is defined at least in part by an outer wall that is preferably partially open to facilitate air flow into the engine block. In accordance with one version of the invention the carburizing of the fuel mixture may occur within the engine without the need for a separate external carburetor for providing the gas-air mixture. There may be provided a filter means over the open compartment wall to filter the outside air entering the engine block. In this regard the rotor includes an air intake passage which permits air passage from the power transfer compartment to the cylinders in succession under each piston. This air intake passage may have blades associated therewith to force the air into each cylinder. The rotor also includes a transfer port which opens subsequently to push the air from under the piston into a mixing chamber within the rotor where the air is mixed with the fuel particles and thereafter passes through the air-fuel intake port to the cylinder above the piston. This occurs, of course, at the initiation of the compression stroke with the exhausting of gases occurring as new mixture is being admitted into the cylinder. In accordance with the invention the fuel is preferably coupled from a fuel supply under pressure to lines within the output shaft which connect to radial fuel coupling lines that terminate at a porous medium or membrane disposed within the mixing chamber of the rotor. Thus, as the output shaft rotates the fuel is centrifugally delivered through the porous membrane where the particles are broken down into atomized size and mixed with the heated air forced from the cylinder under pressure during the downstroke of a piston.

One important feature of the present invention is the provision for continuous combustion. In this regard the rotor is provided with an ignition passage or ignition recess which is positioned so that igniting gases from a previously ignited cylinder are conveyed to an adjacent cylinder when the piston in the adjacent cylinder is at about top dead center position to cause ignition at that position.

Electric heating coils or the like may also be associated with the ignition passage or recess to enhance ignition.

In accordance with another feature of the present invention it is possible to generate an electrical signal which can be used to power devices associated with the engine directly from the engine. In this regard the rotor can be provided with a magnetic circuit and a section of the block may define a stator having windings associated therewith from which an electrical signal can be coupled. The relative rotation between the stator and the rotor induces a voltage in the windings and when a load is connected to the winding, then voltage is established across the load. For example, the load could be a light, horn, or instruments associated with the vehicle.

In accordance with another important feature of the present invention there is provided an improved power transfer means which forms a part of apparatus for converting between linear motion and rotary motion. In the disclosed embodiment herein, linear motion from connecting rods driven from pistons is converted into rotary motion in the form of the rotation of an output shaft. However, in an alternate embodiment the engine could be converted to a compressor wherein the input is rotary motion and the output is linear motion. In accordance with this aspect of the invention there is provided shaft means, and power transfer means including inner and outer members inclined to the shaft means and an intermediate bearing means which may be a roller bearing for providing relative support between the inner and outer members. The inner member is fixed to the shaft while the outer member is essentially driven at its periphery by a linear motion member which in the disclosed embodiment is a connecting rod of a piston. The linear motion member is driven in a direction preferably parallel to the shaft means. The combination also includes a joint means preferably in the form of a universal joint disposed at the periphery of the outer member and supported thereby and for intercoupling the linear motion member to the outer member. In the disclosed embodiment there are a plurality of linear motion members which are driven in succession to provide peripheral forces to the inclined power transfer means transfer power through the bearing means to cause rotation of the inner member which in turn causes rotation of the output shaft. In an inverse sense, the shaft can be driven through the power transfer means to cause linear operation of the linear motion members. This arrangement may be used, for example, in a compressor.

DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
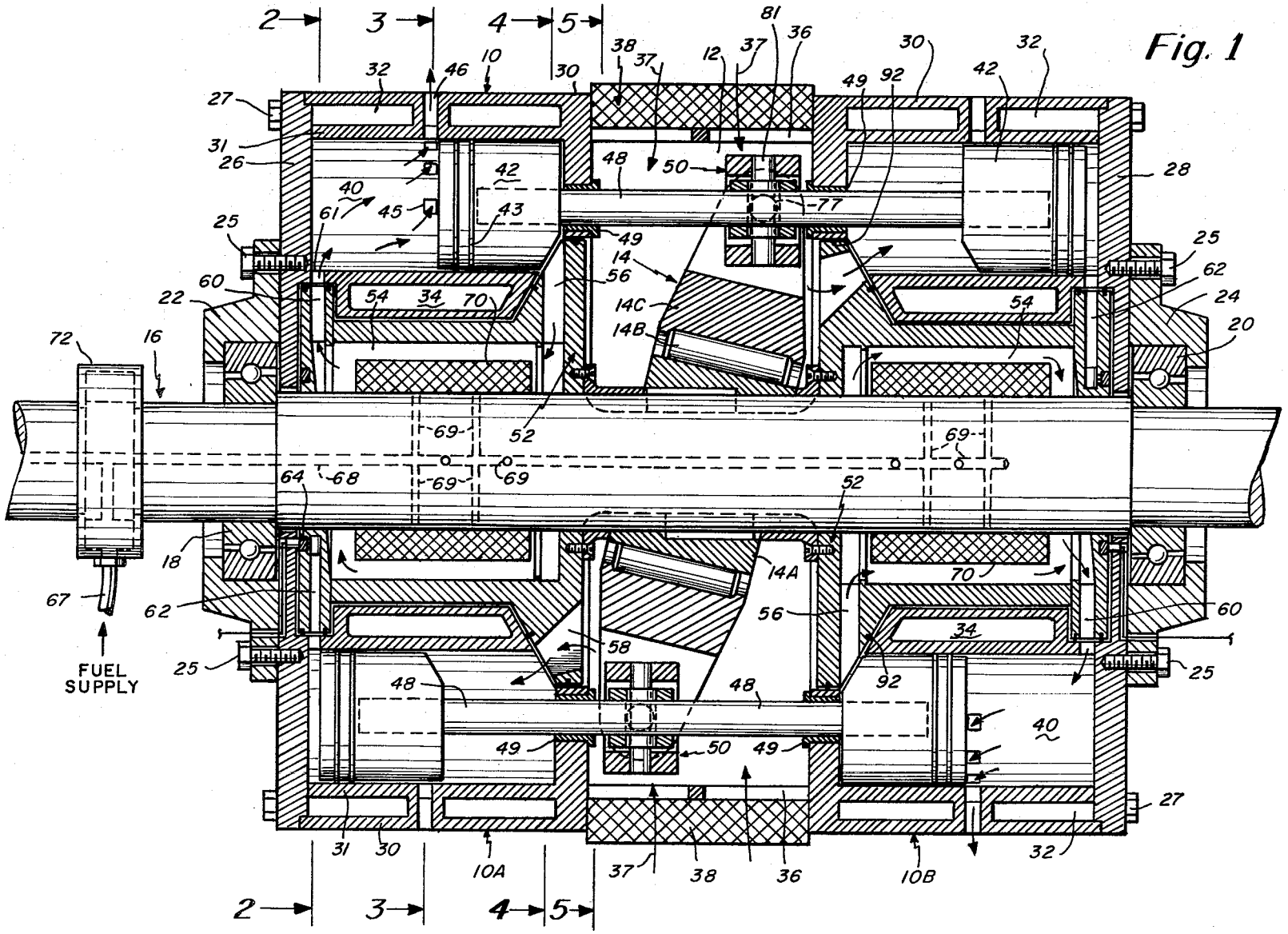
FIG. 1 is a longitudinal cross-sectional view taken through an engine constructed in accordance with the principles of this invention.

FIG. 1 is a cross-sectional view taken through a preferred construction of an engine in accordance with the present invention. FIGS. 2–5 show different cross-sections taken through the engine of FIG. 1. FIGS. 6–11 schematically represent different positions of one of the pistons in the cycle of operation. The embodiment described herein is for a two-cycle operation, although, the principles may also be applied for four-cycle operation. Also, the principles of the invention may be applied in a diesel engine or in an engine having a dual combustion cycle. Furthermore, the principles of the invention may be applied with different types of techniques for providing the air-gas mixture, including techniques furthered in accordance with the invention. Also, the principles of the invention may be used in association with different types of ignition and although the principles preferably embody continuous ignition principles may also be used in association with engine construction using spark plugs and diesel heating coils, for example.

The engine comprises a cylinder block 10 having a left bank 10A and a right bank 10B as depicted in FIG. 1. Between the banks 10A and 10B there is provided a compartment 12 within the cylinder block and in which is disposed the power transfer member 14. With regard to member 14 reference is also made hereinafter to FIG. 12. The output driven shaft 16 is supported within the cylinder block 10. The shaft 16 is supported at opposite ends by means of the bearings 18 and 20 which may be conventional roller bearings extending about the shaft ends and supported within respective cap members 22 and 24. The cap members 22 and 24 may be of circular shape and may be secured to the heads 26 and 28. The heads 26 and 28 are in turn secured to the cylinder block 10. In FIG. 1 there are a series of bolts 25 which are used to secure the cap members 22 and 24 to their respective heads 26 and 28. Similarly, bolts 27 may be employed for securing the heads 26 and 28 to the respective banks 10A and 10B of the cylinder block.

Figure 3:
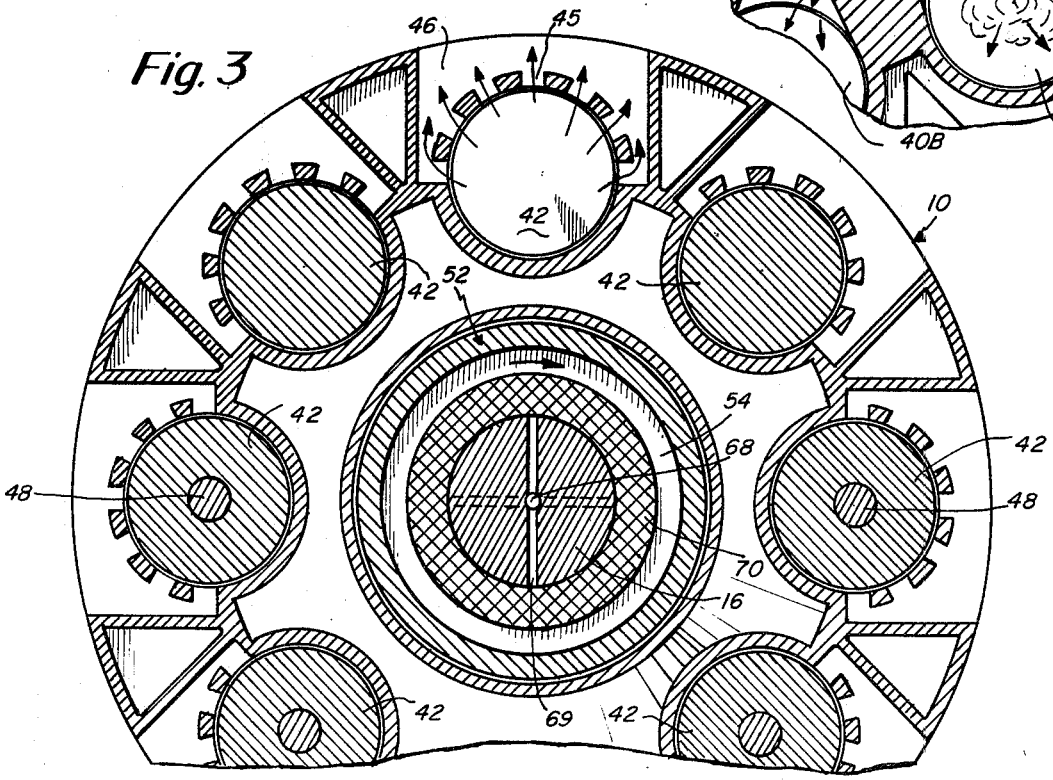
FIG. 3 is a cross-sectional view taken along line 3—3 showing the exhaust porting.

The cylinder block 10 in each bank has means defining water jackets. For example, in FIG. 2 there is shown the outer wall 30 of the block and the inner walls 31 which define the cylinder. The water jacket is defined between walls 30 and 31 as a water compartment 32. As depicted in FIG. 3 there is also an inner compartment 34 for accommodating water. The compartments 32 and 34 may be in communication with each other.

The cylinder block 10 also includes an intermediate wall 36 that has passages therethrough as indicated by the arrows 37 in FIG. 1. These passages permit the passage of air from outside of the cylinder block through the filter 38 into the compartment 12.

The cylinder block walls such as wall 31 defines a plurality of cylinders 40 within which the pistons 42 move. The exhaust of gases from the cylinder is through a plurality of openings 45 to an exhaust port 46. In this regard also note the cross-sectional view of FIG. 3. The piston 42 preferably also supports piston rings 43. In the diagram of FIG. 1 two such rings are used. However, more piston rings could be employed or the piston could be provided with other means associated therewith for maintaining pressure in the cylinder. There is a connecting rod 48 associated with each of the pistons 42. In the disclosed embodiment there are eight pistons in each of the banks 10A and 10B and thus there are a corresponding number of connecting rods 48. These connecting rods extend only in a linear direction and thus their attachment to the piston 42 can be in a simple manner being directly fixed to the piston. Alternatively, a piston pin arrangement could be provided between the connecting rods 48 and the piston 42.

Actually, in the embodiment of FIG. 1 the connecting rod 48 such as the one shown at the top end of the cylinder block in FIG. 1, may be a single piece captured at its midpoint by the universal joint 50.

Figure 4:
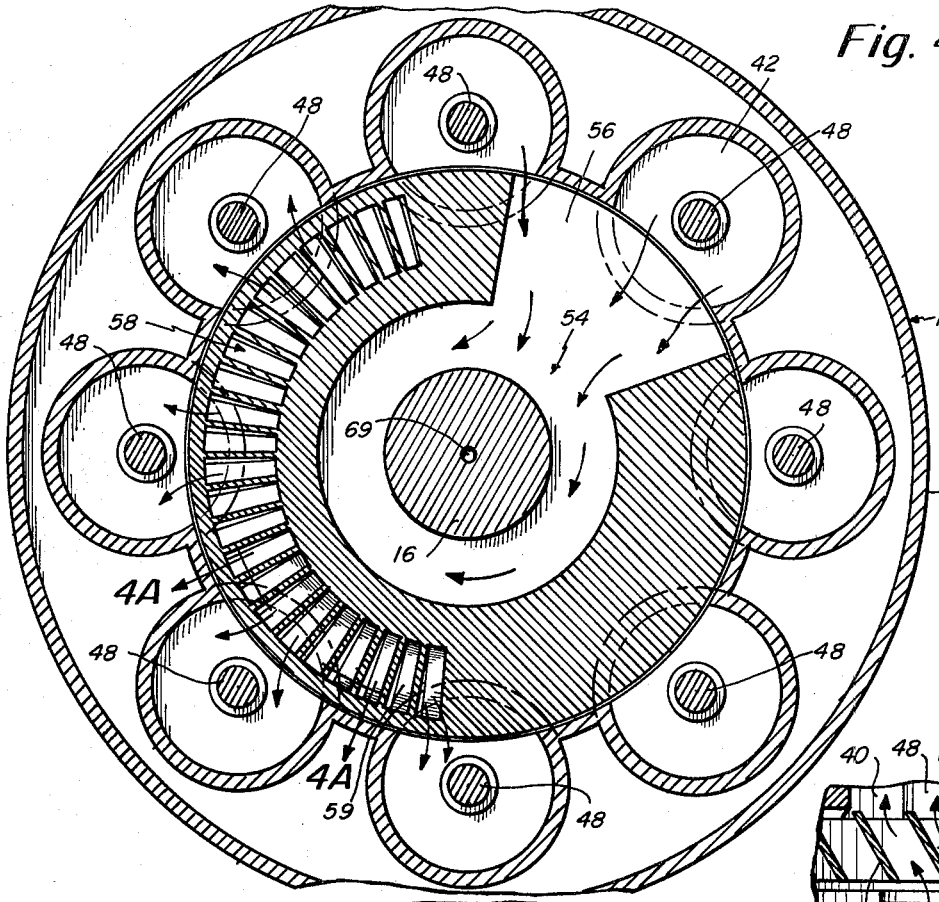
FIG. 4 is a cross-sectional view taken along line 4—4 of FIG. 1 and showing the transfer port and the lower air intake port to the cylinder.
Figure 4A:
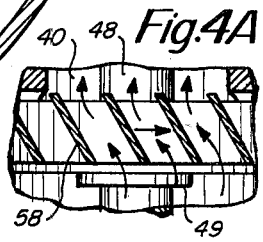
FIG. 4A is a cross-sectional view taken along line 4A—4A of FIG. 4 showing the blade arrangement of the air intake passage.

Within each bank there is provided a rotor 52 which is keyed to and rotates with the driven shaft 16. The rotor 52 defines an annular internal compartment or chamber 54. It is within the chamber 54 that the air and gas mixture is atomized. In this connection the rotor 52 is provided with a transfer port 56 which communicates between the cylinder area under the piston and compartment or chamber 54. FIG. 4 shows the transfer port 56 which is open for about 90° of rotation. At the same end of the rotor there is also provided a lower intake port 58 which is also depicted in FIG. 4. The port 58 is provided with a plurality of blades 59 that assist in moving the air from the compartment 12 into the cylinder beneath the piston 42. The lower intake port 58, as shown in FIG. 4 is open for approximately 180° of rotation of the output shaft.

At the opposite end of the rotor 52, there is provided an upper intake port 60 which operates in conjunction with the transfer port 56 to transfer the atomized gas-/air mixture through the intake port 61 in the block into the cylinder. At the same end of the rotor there is also provided an ignition passage 62 which may have associated therewith an igniter 64. The igniter 64 may be in the form of a spark plug or the like that provides an initial spark upon starting of the engine. Thereafter, this igniter need not be used as the combustion is a continuous combustion transferred by the passage 62 from one cylinder to the next. Thus, in FIG. 2 the cylinder 40A represents a sequence of the cycle just after ignition while the cylinder 40B shows ignition just starting in that cylinder occasioned by the passage of ignited gases via the passage 62 from cylinder 40A to cylinder 40B to cause ignition in cylinder 40B.

It was previously mentioned that air passes into the engine through the filter 38 and the compartment 12 by way of the lower intake port 58 into the cylinder. The fuel product is introduced from a fuel supply, preferably under pressure, to the inlet line 67. The fuel can from there travel to the fuel passage 68 within the shaft 16. The fuel is then dispersed radially through passages 69 and through the porous medium 70 to the chamber 54 where the vaporized gas mixes with the incoming air in readiness for transfer to the upper intake port 60. Between the input line 67 and the distribution line 68 there is provided a coupling 72 which is preferably maintained stationary sealed about the shaft 16 and allowing cyclic transfer of fuel from the inlet line 67 to the distribution line 68.

Figure 2:
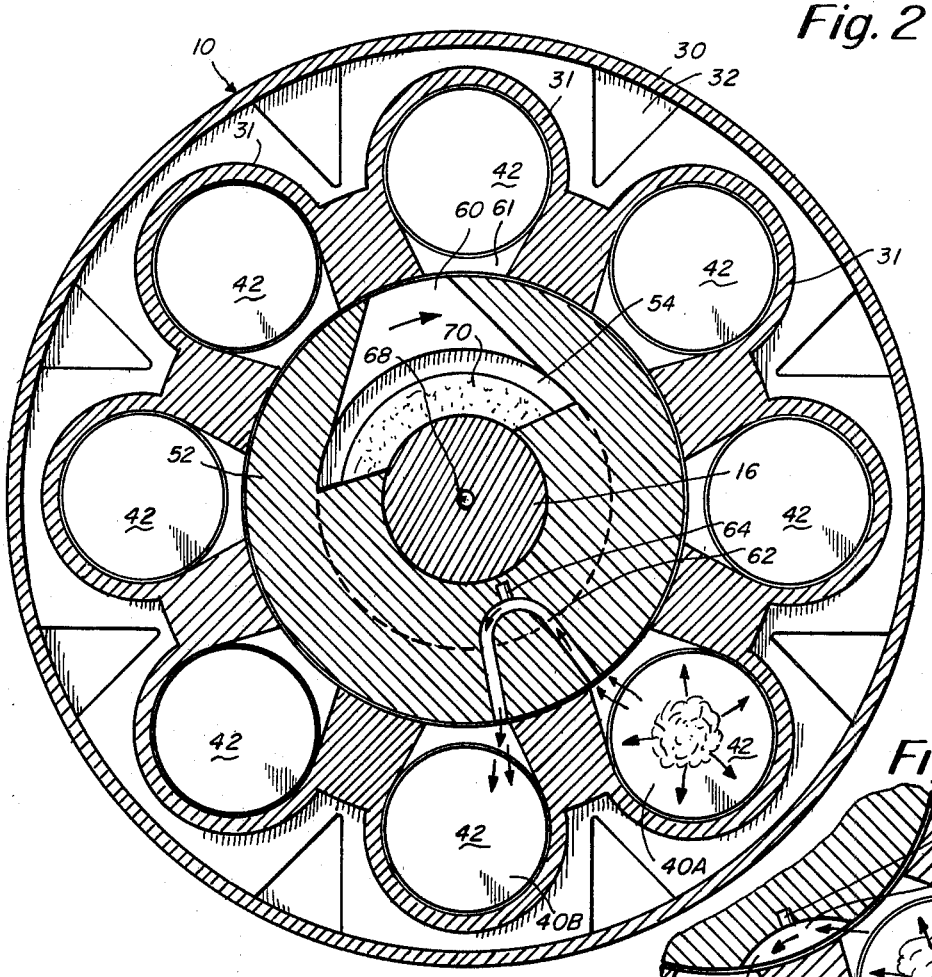
FIG. 2 is a cross-sectional view taken along line 2—2 of FIG. 1 and showing the ignition passage and the air-fuel intake passage.
Figure 2A:
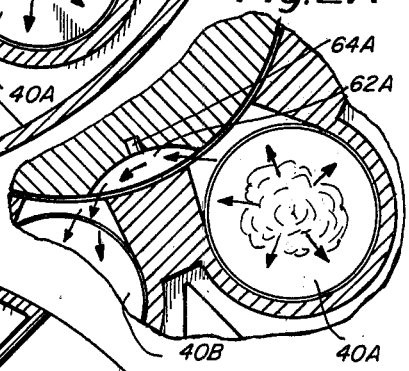
FIG. 2A is a modified embodiment of the invention shown in FIG. 2.

FIG. 2A shows a slightly different embodiment of the present invention wherein the passage 62 is replaced by a recess 62A for providing transfer of igniting gases from cylinder 40A to cylinder 40B. The recess 62A may also have associated therewith an igniter 64A.

Figure 5:
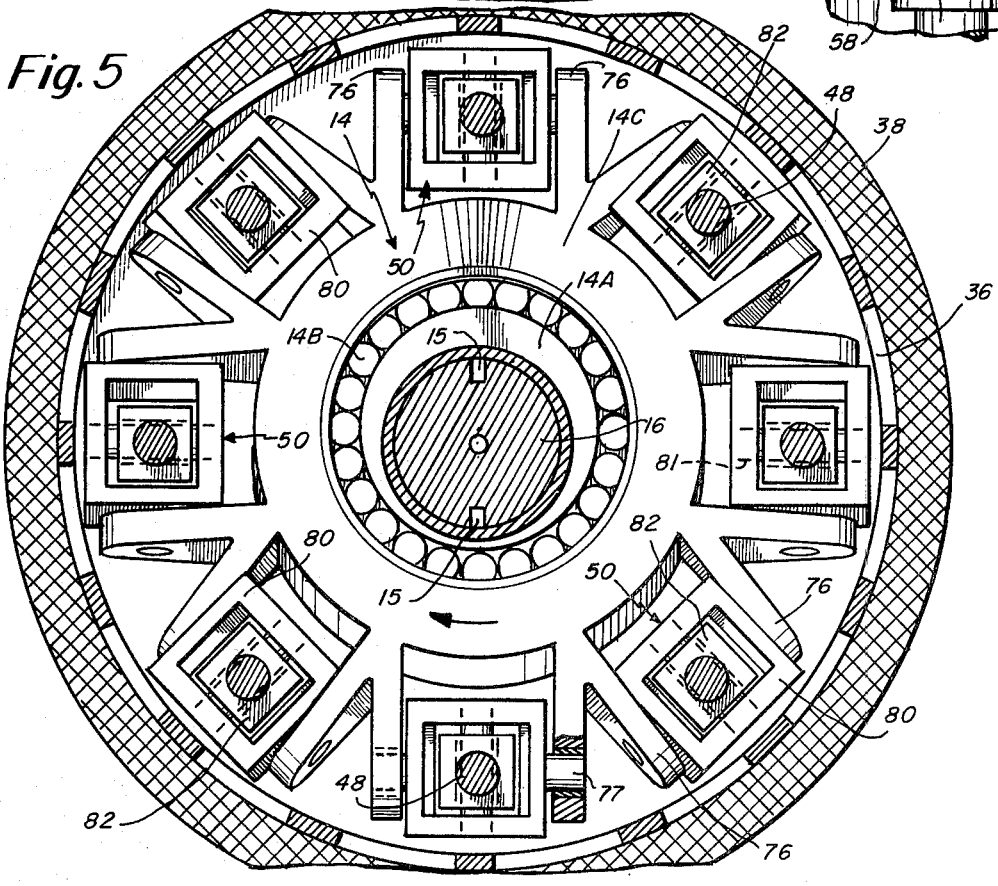
FIG. 5 is a cross-sectional view taken along line 5—5 showing further detail of the power transfer means.
Figure 14:
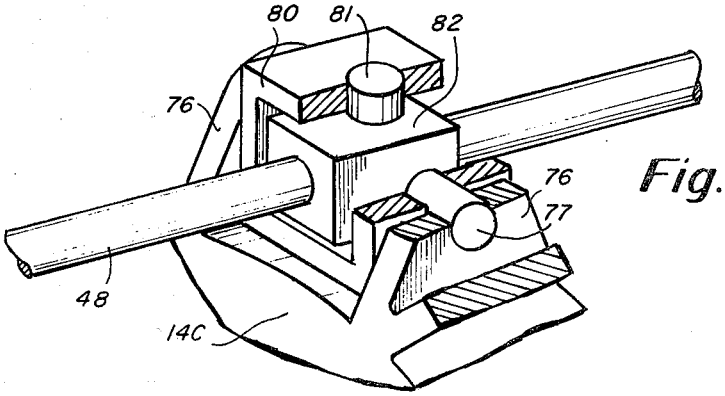
FIG. 14 is a perspective view of the connecting joint between the power transfer member and the piston connecting rods.

The power transfer member 14 depicted in FIGS. 1 and 5 includes an inner piece 14A which is keyed by keys 15 from the output shaft 16. The transfer member also includes a roller bearing 14B and an outer piece 14C. In place of the roller bearing 14B there may also be provided a ball bearing which may be of conventional design. The outer piece has spaced pairs of ears 76 that support therebetween a shaft 77 that forms part of the universal joint 50. The universal joint 50 includes an outer member 80 and an inner member 82. The end shafts 77 are supported in the outer piece 80 and it is also provided a shaft 81. A bearing is preferably provided about the middle of shaft 81 between the shaft 81 and the inner member 82. With this universal joint the connecting rod 48 is permitted to move only in a linear manner. In this regard note the bushings 49 which function as guides for the connecting rod 48. The shaft 81 permits the inner piece 82 to move relative to the outer piece 80 as the transfer member 14 undulates back and forth. However, the outer section 14C of the member 14 does not rotate. It only moves generally in the direction of the connecting rods. See also FIG. 14.

FIGS. 6–11 depict the operation of one piston at different sequences of the cycle of operation. With regard to the diagram of FIG. 1 the power stroke occurs in one bank in sequence. Thus, with the use of eight pistons per bank there is an initiation of a power stroke at each 45° of rotation. Also, there is a like sequence for the other bank. For example, with regard to FIG. 1 if it is assumed that the lower left piston is commencing its power stroke, then at the very same time the upper right hand piston is also commencing its power stroke to provide at diametric positions of the transfer member 14 like forces for causing rotation of theoutput shaft. Reference is made hereinafter to FIG. 12 for a further description of the transfer member 14.

Figure 6:
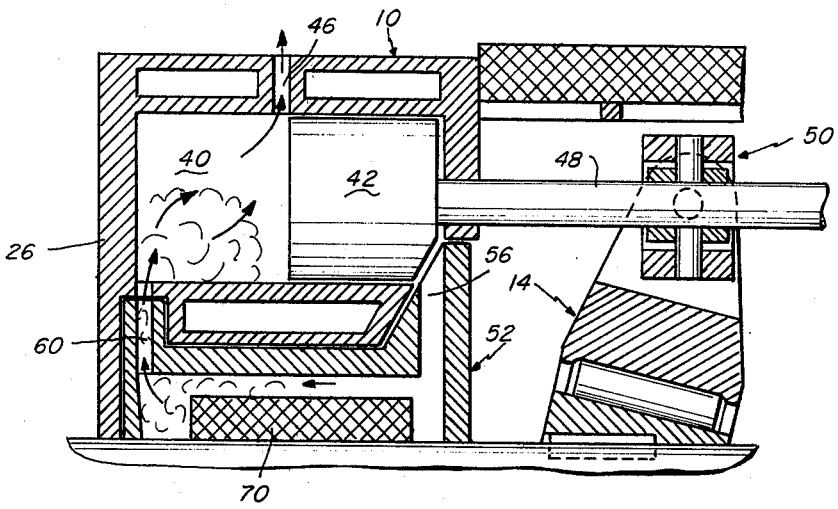
FIGS. 6–11 schematically describe in sequence different positions of one of the pistons of the engine through a full cycle of operation from a bottom dead center position to a top dead center position at ignition and back toward a bottom dead center position.

In FIG. 6 the piston 42 is at its bottom dead center position. This is essentially at the end of the power stroke with the exhaust port 46 open. In fact, the exhaust port 46 has been open for 35° of rotation of the output shaft. The upper intake port 60 is open but has been open for only approximately 5° of rotation. The input port 60 allows intake of the air-fuel mixture for 40° of rotation. In FIG. 6 the transfer port 56 is open but is about to close. FIG. 4 shows the transfer port 56.

Figure 7:
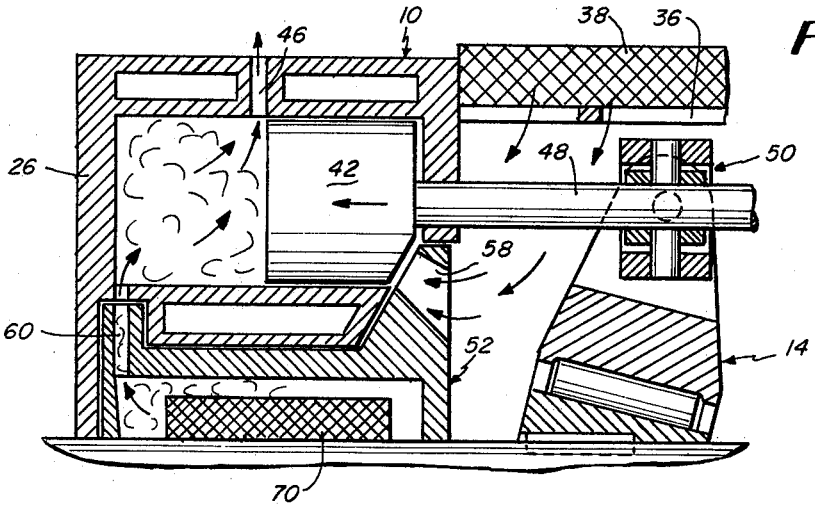

FIG. 7 shows the position of piston 42 and the power transfer member 14 after 5° of rotation in comparison to the position shown in FIG. 6. In FIG. 7 the transfer port 56 has closed and the lower intake port 58 has just opened. In this position it is noted that the upper intake port 60 is still in its open position permitting transfer of the fresh mixture into the cylinder. The exhause port 46 is still at least partially open still permitting escape of the burnt gases.

Figure 8:
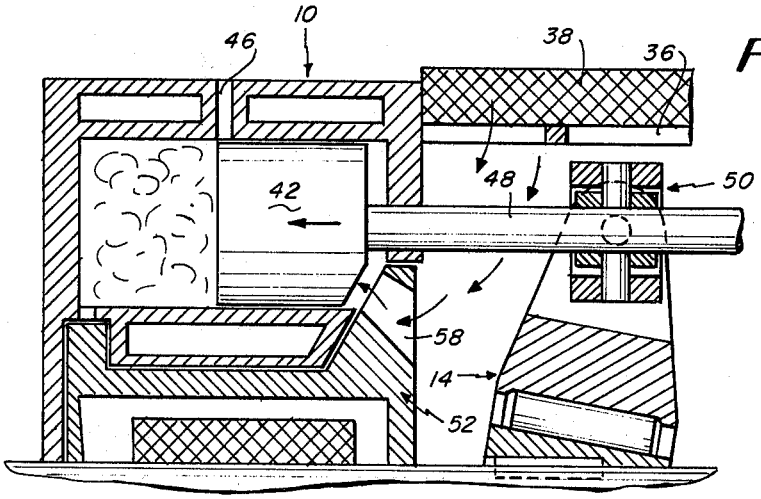

In FIG. 8 the piston has moved to a position wherein the output shaft is rotated 35° from the bottom dead center position of the piston. At this time the exhaust port is closed as is the upper intake port 60. This is now the commencement of the compression stroke. In the position of FIG. 8 the lower intake port is still open. The air entering through the filter 38 into the chamber 12 passes through the port 58 into the lower portion of the cylinder below the piston 42. This occurs under a sucking action occasioned by the movement of the piston 42 towards its bottom dead center position.

Figure 9:
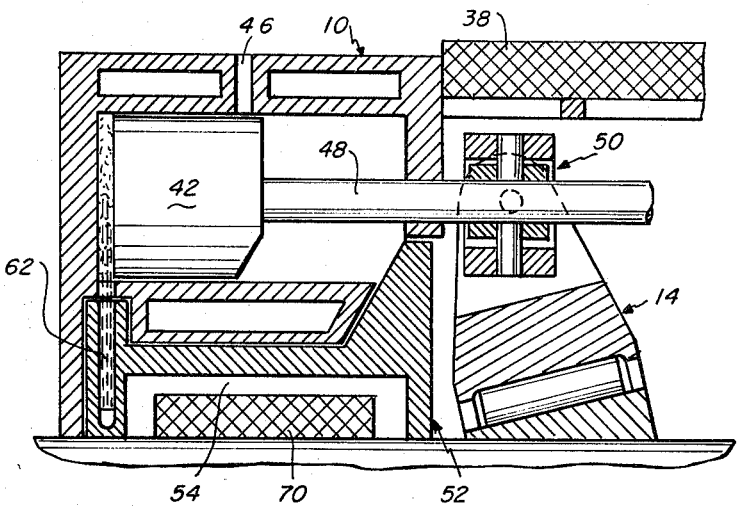

FIG. 9 shows another position of the piston in its sequence of movement. In FIG. 9 the piston is shown at its top dead center position with the fuel-air mixture fully compressed. Ignition of the mixture occurs by way of the passage 62. This action initiates the power stroke. In this regard reference is made to FIG. 2 which shows the passage 62 and the communication of igniting gases from cylinder 40A to cylinder 40B to cause ignition of the mixture and initiation of the power stroke. After 45° of further rotation the ignition presently in process in the cylinder 40B is then transferred to the next adjacent cylinder to cause ignition therein. This continuous form of combustion is maintained with the ignition being generated on a cylinder by cylinder basis. It is also noted in FIG. 9 that the lower intake port 58 is now closed. However, air has been drawn into the cylinder 40 below the piston 42 in readiness for being transferred to the chamber 54.

Figure 10:
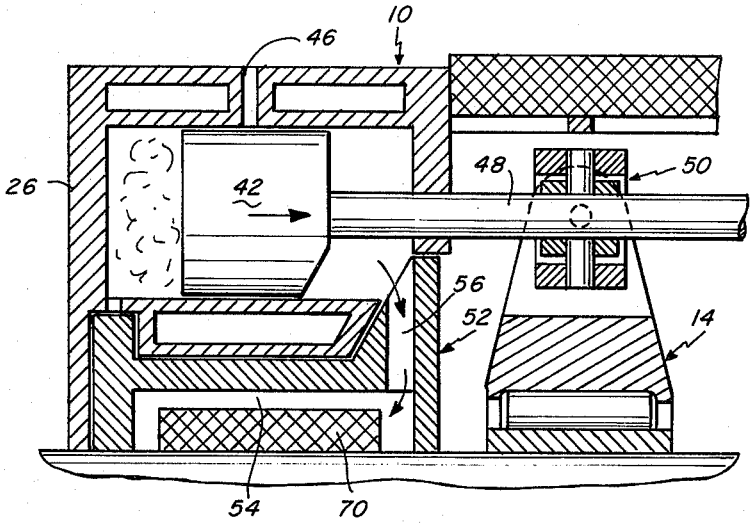

FIG. 10 shows the piston 42 in the midst of its power stroke at 90° rotation beyond the top dead center. At this point the transfer port 56 now opens. In the position of FIG. 10 the inlet port 60 has not yet opened and the exhaust port 46 is still blocked.

Figure 11:
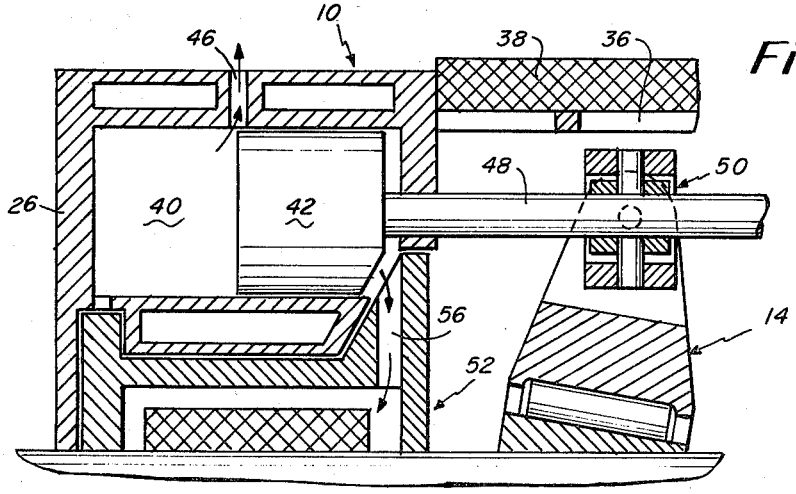
Figure 12:
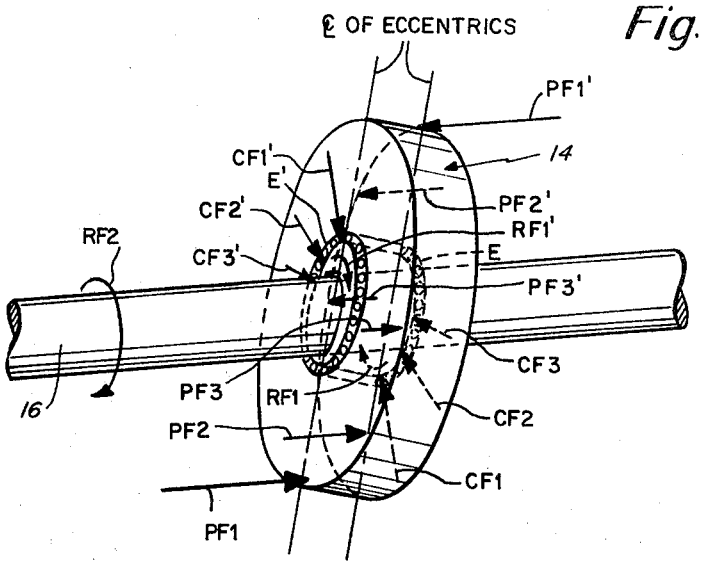
FIG. 12 is a schematic representation of the power transfer member depicting forces on this member that create the rotational force for driving the output shaft.

FIG. 11 shows the exhaust port 46 just now opening at a position 35° before bottom dead center. In this position the transfer port 56 is still opened. The intake port 60 is still closed but will open 5° before the bottom dead center position. When this opens then the air coupled from the port 56 and atomized with the fuel introduced the medium 70 will pass through the input port 60 into the cylinder 40 as in the illustration of FIG. 6.

FIG. 12 illustratively depicts the operation of the power transfer member 14 and its relationship with and the manner in which it causes rotation of the output shaft 60. For the sake of simplicity the interconnecting universal joints at the perimeter of the member 14 are not shown. Instead, force arrows are used to depict the forces applied by the pistons via their connecting rods to the member 14. FIG. 12 also shows the support bearing 14B which permits the outer section 14C to be maintained stationary (non-rotatable) while the inner section 14A is permitted to rotate, it being keyed with the output shaft 16. In FIG. 12 the forces PF1, PF2 and PF3 represent forces imposed upon the power transfer member 14 from one bank of pistons while the opposite bank generates forces PF1′, PF2′ and PF3′. The forces PF1 and PF1′ represent the maximum force of one of the pistons at top dead center at initial ignition. Thus, with respect to one bank the force PF1 represents the piston presently at the top dead center while forces PF2 and PF3 represent residual forces from previously ignited pistons. The force PF1 is preferably timed to occur just off center of the eccentric center lines. The forces PF1, PF2 nd PF3 create complementary forces CF1, CF2 and CF3, respectively resulting from the psiton forces acting through the transfer member and the bearing 14B. These complementary forces create the rotary force RF1 of the inner section 14A which, being keyed to the shaft 16 creates a like force for rotating the shaft.

Similarly, from the opposite bank the forces PF1′, PF2′ and PF3′ create complementary forces CF1′, CF2′ and CF3′. These forces provide a resultant rotating force RF1′ which is additive with the rotating force RF1. FIG. 12 shows the resultant force RF2 which is the sum of the forces RF1 and RF1′.

Figure 13:
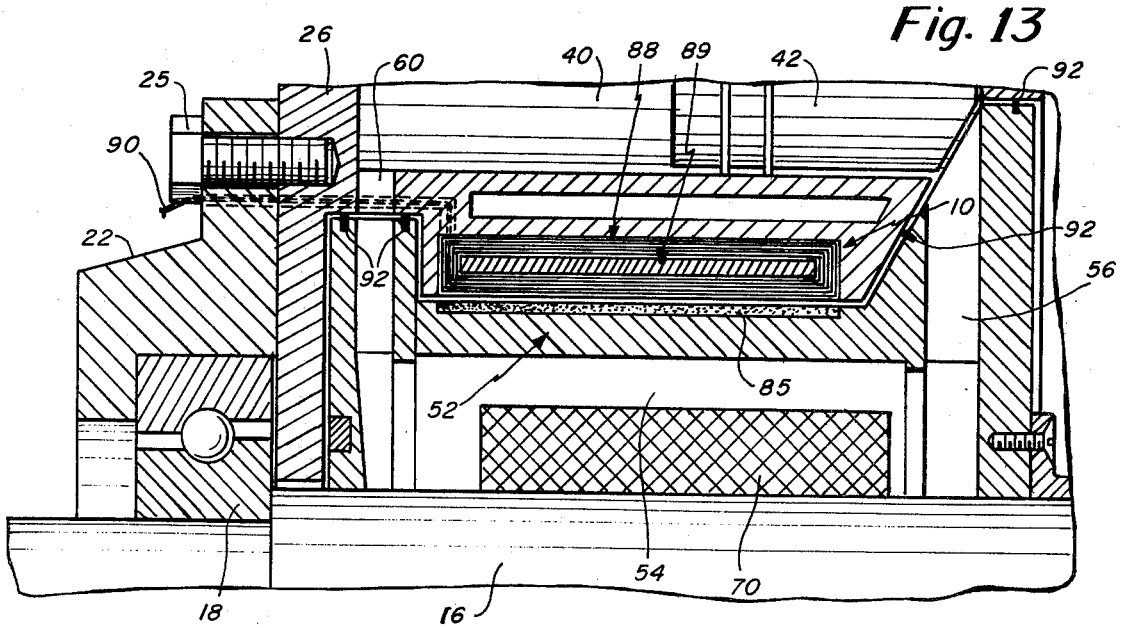
FIG. 13 is a fragmentry cross-sectional view through a portion of the engine including the rotor and showing a modification therein for generating an electrical voltage from the engine directly.

FIG. 13 shows a fragmentary view of a portion of the engine of FIG. 1 showing a modification that permits the generation of electrical power essentially directly from the engine. In this regard the rotor 52 is provided with a magnetic material possibly in the form of a bar 85 imbedded in the rotor. A similar bar 85 may be provided on a diametrically opposite side of the rotor. Associated with the magnetic material 85 are windings 88 and an associated magnetic core 89 which are supported in the stationary cylinder block 10 adjacent to the bar 85. The windings 88 are maintained stationary but as the rotor 52 rotates, there is a voltage established in these windings which may be coupled by way of the cable 90 to an electrical device such as a voltage regulator.

FIG. 13 also shows the use of slip rings 92 also identified in FIG. 1. These slip rings may be of conventional design and provide a control fit between the rotor and the engine block. The slip rings are provided on opposite sides of passage 56 as noted in FIG. 13 and also on opposite sides of the intake passage 60.

By providing the introductin of the fuel through the output shaft 16 there is a centrifugal action that occurs with the fuel particles being expelled through the passages 69 into the porous membrane 70. This action causes an atomizing of the particles which are then mixed with the air forced from the piston by way of the transfer port 56. The air that is introduced under the piston 42 is actually compressed at least partially by the piston so that the heated air moves past the membrane under substantial force and velocity. The mixing occurs and then the air-fuel mixture is passed by way of the intake port 60 into the cylinder above the piston. Herein, when referring to below the piston as viewed in FIG. 1 in the upper left corner it is meant to the right side of the piston and above the piston refers to the left side of the piston.

The engine depicted herein has associated therewith a lubricating system that is not shown in any detail herein. The lubricating system may comprise an oil reservoir, an associated oil pump, and oil lines that would couple oil to all of the areas that require lubrication. Some areas requiring lubrication are the cylinder walls, the bearings 18 and 20, the joint 81, and the main roller bearing 14B. Alternatively, an oil mist type of lubricating system could also be employed.

Having described one embodiment of the present invention, it should now become apparent to those skilled in the art that numerous other embodiments are contemplated as falling within the scope of this invention, for example, the engine could operate employing only a single bank of pistons instead of the dual tandem operating bank as disclosed. Furthermore, fewer than eight pistons could be used in each bank or possibly more than eight pistons could be used. The engine described has been a two-cycle engine, although, the principles may also be applied in conjunction with operating a four-cycle engine. In that regard the construction of the rotor would in particular, be different. Although a continuous combustion technique is preferred in accordance with the invention, standard spark ignition can also be employed in its place or in conjunction therewith. The principles of the invention may also be used in association with a fuel injection type of system or in association with diesel type operation. The engine may also be designed for use with a dual combustion cycle. Although the ignition recess or passages are not specifically described herein as having heating elements associated therewith, they can have electrically heated elements associated with the passage or recess. Also, the engine control can have associated therewith exhaust modulation for controlling back pressure in the engine. In the described embodiment the power transfer compartment also forms a passage for air intake. However, in an alternate embodiment there may be separate air passages segregated from the power transfer member.

What is claimed is:

1. An internal combustion engine comprising;

an engine block having means defining a plurality of cylinders arranged in a circular locus and means defining a power transfer compartment adjacent the cylinder, output shaft means, means supporting the output shaft means in a rotatble position in the engine block, a plurality of pistons received each in a cylinder and each having connecting means extending therefrom and into the power transfer compartment, said engine block having means defining at leat one exhaust port and intake port for the cylinder, rotor means secured to the output shaft means rotatable therewith and having at least one intake passage for coupling an air-gas mixture to one end of the cylinder over the piston via the intake port, and an eccentrically-operated power transfer means disposed in the power transfer compartment for converting linear piston action into rotary output shaft means action including an inner member fixed with the output shaft means and an outer member coupled to the connecting means permitting undulation of the power transfer means with the outer member non-rotatng relative to the output shaft means, said rotor means also including an air intake passage at one side of the rotor means to permit air flow into the cylinder under the piston at an opposite end of the cylinder, a transfer passage at the opposite side of the rotor means coupling from the opposite end of the cylinder to the intake passage, and means coupling fuel to the transfer passage wherein the fuel and air mix for coupling under pressure to the intake passage, said means coupling fuel including fuel coupling lines within the output shaft means and a porous member through which the fuel particles pass to the transfer passage wherein the air under pressure passes over the porous member to the intake passage.

2. An internal combustion engine as set forth in claim 1 wherein said means supporting the output shaft means includes bearings at opposite ends of the engine block.

3. An internal combustion engine as set forth in claim 1 including blades in the air intake passage to force air into the cylinder.

4. An internal combustion engine as set forth in claim 1 including an ignition passage in the rotor means for transferring ignited gases in a previously ignited cylinder to an adjacent cylinder to cause ignition therein.

5. An internal combustion engine as set forth in claim 1 including an ignition cavity in the rotor means for transferring ignited gases in a previously ignited cylinder to an adjacent cylinder to cause ignition therein.

6. An internal combustion engine as set forth in claim 1 wherein a section of the engine block defines a stator and a section of the rotor means defines a rotor and further including winding means associated with the stator for generating an electric signal directly from the engine.

7. An internal combustion engine as set forth in claim 1 wherein the air intake passage is dimensioned to feed air to the piston underside at a shorter rotation distance than the passage of air-fuel mixture to the piston top side.

8. An internal combustion engine as set forth in claim 1 wherein said power transfer compartment includes outer wall means at least partially open to facilitate air flow into the engine block.

9. An internal combustion engine as set forth in claim 8 including filter means over the open wall means to filter the outside air entering the engine block.

10. An internal combustion engine as set forth in claim 1 wherein said engine block has two banks of cylinders separated by the power transfer compartment, each bank having the same number of cylinders thus having a like plurality of pistons in each bank, corresponding piston pairs one from each bank being in linear alignment.

11. An internal combustion engine as set forth in claim 10 wherein a common connecting means is used for aligned pistons and including a joint means at substantially the midpoint of the connecting means for interconnecting the connecting means with the outer member of the power transfer means.

12. An internal combustion engine as set forth in claim 11 including roller bearing means disposed between the inner and outer members of the power transfer means permitting relative rotation between the inner and outer members.

13. An internal combustion engine as set forth in claim 11 wherein the inner and outer members of the power transfer means form a plate which is at all positions skewed to the axis of the output shaft means.

14. An internal combustion engine as set forth in claim 11 wherein said joint means includes a sliding joint that enables undulation of the outer member while maintaining the connecting means in only linear motion.

15. An internal combustion engine as set forth in claim 14 wherein said engine block has means defining a guide for the connecting means to limit the connecting means to only linear motion.

16. An internal combustion engine comprising;

an engine block having means defining a plurality of cylinders arranged in a circular locus and means defining a power transfer compartment adjacent the cylinders, output shaft means, means supporting the output shaft means in a rotatable position in the engine block, a plurality of pistons received each in a cylinder and each having connecting means extending therefrom and into the power transfer compartment, said engine block having means defining at least one exhaust port and intake port for the cylinder, rotor means secured to the output shaft means rotatable therewith and having at least one intake passage for coupling an air-gas mixture to one end of the cylinder over the piston via the intake port, and an eccentrically-operated power transfer means disposed in the power transfer compartment for converting linear piston action into rotary output shaft means action including an inner member fixed with the output shaft means and an outer member coupled to the connecting means permitting undulation of the power transfer means with the outer member non-rotating relative to the output shaft means, said rotor means also including an air intake passage at one side of the rotor means to permit air flow into the cylinder under the piston at an opposite end of the cylinder, a transfer passage at the opposite side of the rotor means coupling from the opposite end of the cylinder to the intake passage, and means coupling fuel to the transfer passge wherein the fuel and air mix for coupling under pressure to the intake passage, wherein said transfer passage extends between ends of the rotor, and a porous member extending at least partially along the transfer passage and adapted to receive therethrough the fuel, said air from the underside of the piston passing under force across the porous member parallel to the outer surface thereof.

17. An internal combustion engine comprising;

an engine block having means defining a plurality of cylinders arranged in a circular locus and means defining a power transfer compartment adjacent the cylinders, output shaft means, means supporting the output shaft means in a rotatable position in the engine block, a plurality of pistons received each in a cylinder and each having connecting means extending therefrom and into the power transfer compartment, said engine block having means defining at least one exhaust port and intake port for the cylinder, rotor means secured to the output shaft means rotatable therewith and having at least one intake passage for coupling an air-gas mixture to one end of the cylinder over the piston via the intake port, and an eccentrically-operated power transfer means disposed in the power transfer compartment for converting linear piston action into rotary output shaft means action including an inner member fixed with the output shaft means and an outer member coupled to the connecting means permitting undulation of the power transfer means with the outer member non-rotating relative to the output shaft means, said rotor means also including an air intake passage at one side of the rotor means to permit air flow into the cylinder under the piston at an opposite end of the cylinder, a transfer passage at the opposite side of the rotor means coupling from the opposite end of the cylinder to the intake passage, and means coupling fuel to the transfer passage wherein the fuel and air mix for coupling under pressure to the intake passage, said rotor means including a mixing chamber therein, means coupling fuel to the mixing chamber and a transfer port coupling air to the chamber therein mixed with the fuel.

18. An internal combustion engine comprising:

an engine block having means defining a plurality of cylinders arranged in a circular locus and means defining a power transfer compartment adjacent the cylinders, output shaft means, means supporting the output shaft means in a rotatable position in the engine block, a plurality of pistons received each in a cylinder and each having connecting means extending therefrom and into the power transfer compartment, said engine block having means defining at least one exhaust port and intake port for the cylinder, rotor means secured to the output shaft means rotatable therewith and having at least one intake passage for coupling an air-gas mixture to one end of the cylinder over the piston via the intake port, and an eccentrically-operated power transfer means disposed in the power transfer compartment for converting linear piston action into rotary output shaft means action including an inner member fixed with the output shaft means and an outer member coupled to the connecting means permitting undulation of the power transfer means with the outer member non-rotating relative to the output shaft means, said rotor means also including an air intake passage at one side of the rotor means to permit air flow into the cylinder under the piston at an opposite end of the cylinder, a transfer passage at the opposite side of the rotor means coupling from the opposite end of the cylinder to the intake passage, and means coupling fuel to the transfer passage wherein the fuel and air mix for coupling under pressure to the intake passage, said rotor means including a mixing chamber therein, coupling lines within the output shaft means, means for forcing fuel through the coupling lines and porous membrane means in the mixing chamber through which fuel particles pass.

* * * * *